United States Patent [19]

Sagol

[11] Patent Number: 4,505,408

[45] Date of Patent: Mar. 19, 1985

[54] BEVERAGE CONTAINER WITH COLLAPSIBLE LEGS

[75] Inventor: Sami Sagol, Jaffa, Israel

[73] Assignee: Keter Plastic (USA) Inc., New York, N.Y.

[21] Appl. No.: 556,131

[22] Filed: Nov. 29, 1983

[51] Int. Cl.[3] ..... F16M 11/38

[52] U.S. Cl. ..... 222/185; 108/127; 220/69; 220/902; 222/131; 248/188.6; 248/439

[58] Field of Search ..... 220/69, 18, 902; 248/188.6, 166, 439, 440; 108/127; 222/185, 131; 190/18 A; 280/43

[56] References Cited

U.S. PATENT DOCUMENTS 1,567,484 12/1925 Beard ..... 248/439

2,397,766 4/1946 Tullis ..... 248/188.6 X

*Primary Examiner*—Allan N. Shoap

[57] ABSTRACT

A beverage container having collapsible legs is described, the legs being manually locked in an extended position by frictional engagement with depending members formed in bottom recesses of the container adapted to accommodate the collapsible legs.

6 Claims, 5 Drawing Figures

BEVERAGE CONTAINER WITH COLLAPSIBLE LEGS

BACKGROUND OF THE INVENTION

This invention relates to a portable beverage container having collapsible legs to facilitate convenient transportation of the container to a location where the container is to be used to dispense beverages, at which time the collapsed legs are extended to elevate the container above a supporting surface.

The use of insulated portable beverage containers is well-known in the art. Many of these containers are of cylindrical shape and include a spigot situated at a lower portion thereof to dispense the beverage. Because of the need to situate the spigot at the lower portion of the container, the container must be placed during the dispensing operation on the edge of a table or other supporting surface. This is generally unsatisfactory, since the spigot on the container must protrude over the end face of the supporting surface, at the risk of being displaced by persons in the area of the spigot. Moreover, while the best designed spigot may not leak, when persons use the spigot to dispense beverages, some leakage to the floor or patio etc. inevitably occurs due to the projection of the spigot beyond the edge of its supporting surface.

One solution to this problem is to provide the container with legs. However, this is generally unsatisfactory if the container is constructed from light weight plastic material and designed for portable use which may cause the legs to break during transportation thereof.

SUMMARY OF THE INVENTION

The present invention overcomes the foregoing problems by providing a beverage container having light weight collapsible legs to elevate the container above a supporting surface during use when the legs are extended, thereby to permit dispensing of a beverage at any position on a supporting surface and not necessarily at the end of a supporting surface, and upon collapsing of the legs, facilitating transportation of the container without risk of damage to the legs.

DETAILED DESCRIPTION OF THE INVENTION

Figure 1:
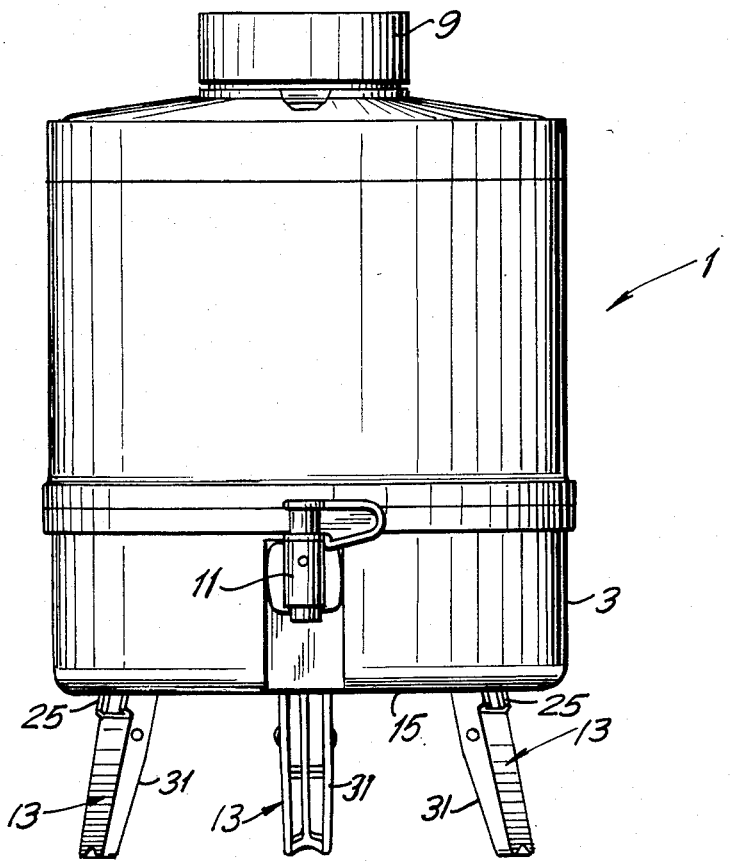
FIG. 1 is a front elevational view of a beverage container according to this invention with the collapsible legs extended.
Figure 3:
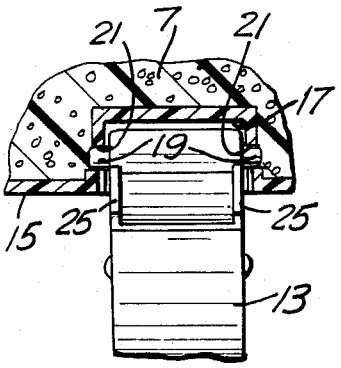
FIG. 3 is a partial section taken along line 3—3 of FIG. 2.

The invention comprises basically a cylindrical jug 1, preferably insulated, and formed by an outer shell 3 and an inner shell 5, separated by a foamed insulating material 7, as well known in the art.

The container 1 is provided with a screw cap 9 and a spigot 11 near its bottom 15 for dispensing beverages as also known in the art.

The container is preferably molded of plastic material, the outer shell 3 of which is provided at the its base 15 with at least three collapsible legs 13. Legs 13 are so designed that they are substantially recessed within the bottom 15 of outer shell 3. This is accomplished by providing the bottom portion 15 of outer shell 3 with a plurality of radially extending recesses 17 adapted to receive and house the legs 13 when they are in the collapsed position.

The legs 13 are pivotably attached to the bottom 15 of shell 3 and within recesses 17 by means of opposed pins 19 integrally moulded on the outside of each leg 13, which pins 19 snap into corresponding lateral holes 21 provided within the recesses 17 of bottom portion 15. The side walls of recesses 17 are provided with inwardly tapered arcuate slots 23 to facilitate assembly of pins 19 into holes 21 by guiding the pins to the holes where they are snapped into the holes, the side walls of recesses 17 having sufficient flexability to facilitate such assembly.

Figure 4:
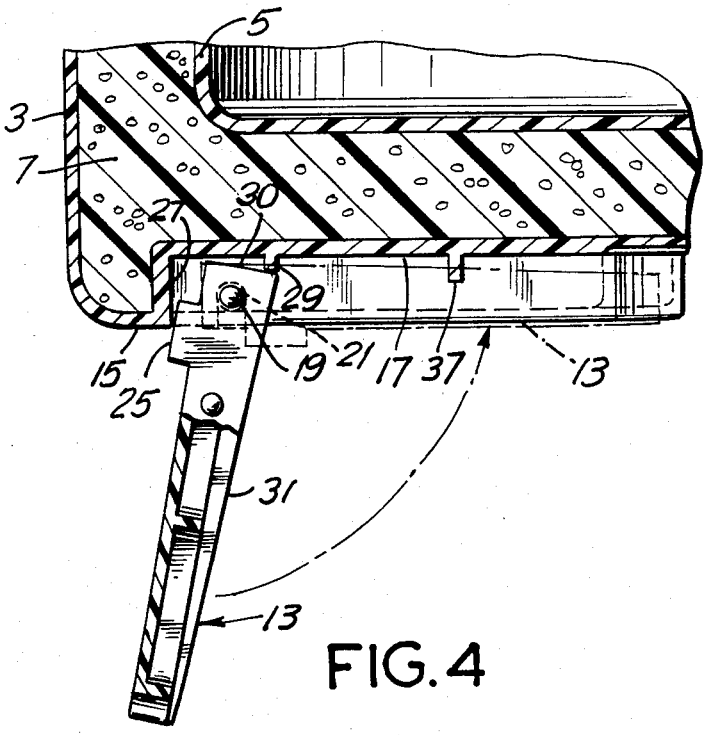
FIG. 4 is a partial section taken along the line 4 of FIG. 2.

In order to secure each legs 13 in an extended position, each leg is provided on a surface facing the outside of the container with a pair of outwardly extending wings 25 which together with each leg abut the outer end faces 27 of recesses 17 (See FIG. 4). The purpose of wings 25 is to provide a stop for legs 13 when in the extended position and thereby permit spacing of the pivot point of pins 19 and legs 13 from the end walls 27 of recesses 17 to enable the legs 13 to pivot without binding on the outer end faces 27 of recesses 17. To accomplish this result wings 25 are spaced from the outer and recessed ends of legs 13 at a distance sufficient to permit pivotal movement of the legs 13 and engagement with the end walls 27 of recesses 17.

Legs 13 are locked into an outermost extended position by means of a member 29 depending from and within each recess 17 and extending laterally thereacross to frictionally engage the upper extended ends 30 of each corresponding leg and snap-lock the leg in an extended position as shown in FIG. 4.

Figure 2:
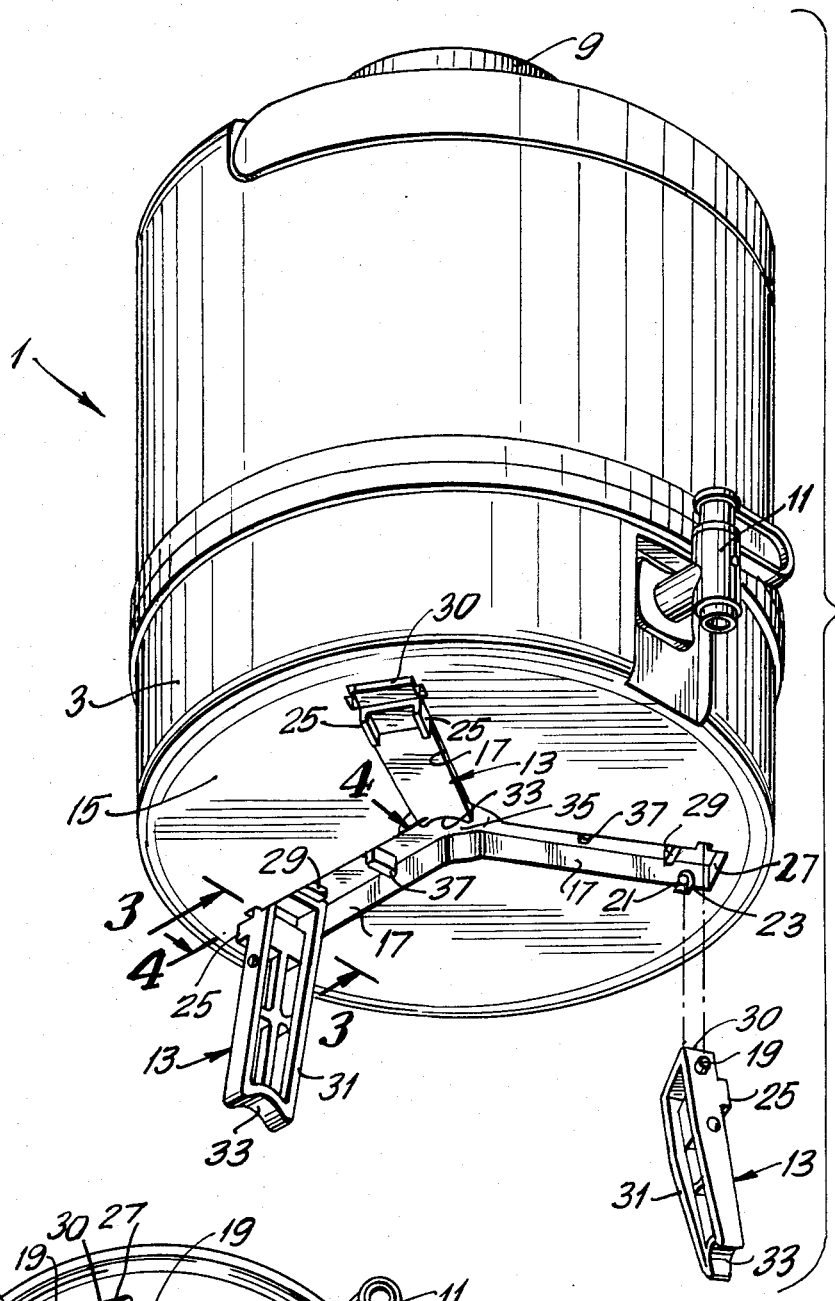
FIG. 2 is a bottom and side elevational view, in perspective, showing in exploded form the manner of attachment of the legs to the container.
Figure 5:
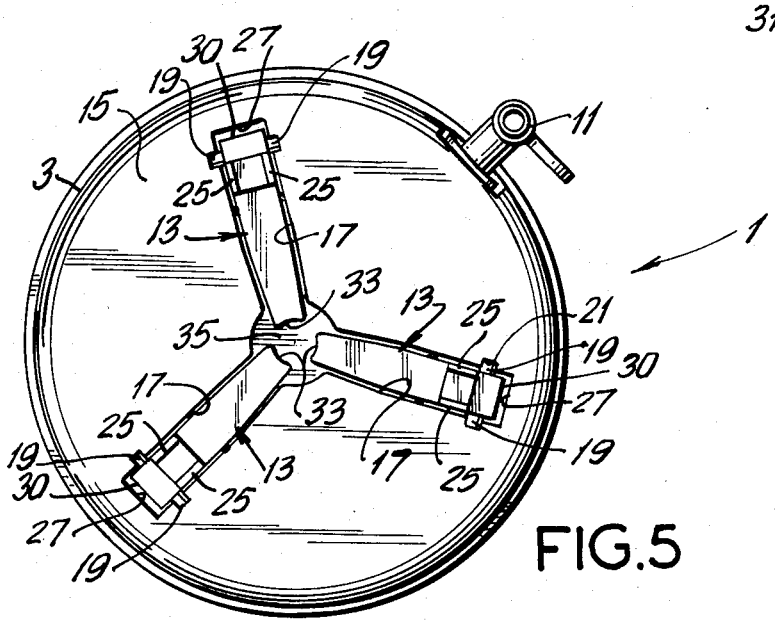
FIG. 5 is a bottom plan view of the container 1.

The inward face of each leg 13 in the collapsed position is tapered at 31 inwardly toward its outer end as particularly shown in FIGS. 2 and 4. Moreover, the outer end of each leg 13 is provided with an arcuate end portion 33. In addition, the bottom 15 of container 1 is provided with a cylindrical recess 35, within which the arcuate ends 33 of legs 13 project. Finally, and to elevate the inner surfaces of legs above the bottom of recess 17 and enable the arcuate ends 33 of legs 13 to be manually engaged and extended to an elevated position, further lateral depending members 37 are provided within each recess to engage the tapered portions 31 of legs 13 and cause the outer surfaces of legs 13 to become substantially flush with the bottom 15 of container 1, while at the same time elevating the arcuate ends 33 of legs 13 above recess 35 to facilitate manually grasping of each leg to lift and extend the same to an upright position.

Resort may be had to such modifications and equivalents as fall within the spirit of the invention and the scope of the appended claims.

What is claimed is:

1. A container for dispensing beverages comprising a cylindrical body having a removable cap at the top thereof and a spigot for dispensing a beverage on a side and near the bottom thereof, at least three collapsible legs pivotally mounted near the outer periphery of the bottom of the container, the bottom of the container forming at least three recesses for receiving said legs extending radially from the center of the bottom and terminating in an end wall near the outer periphery of the container bottom and adapted to house said legs when in a collapsed position, each leg being provided with opposed pins extending outwardly from each side thereof and located near the upper end of each leg when in an upright position, each recess being provided with a pair of opposed inwardly tapered slots terminating beyond lateral holes in the side walls of said slots, said holes receiving the pins on said legs in a pivotal manner, a lateral stop member depending within each recess and disposed at the upper end of each leg when in the upright position and adapted for frictional engagement with the end of each leg to lock same in the upright position and to release same when the leg is manually collapsed and returned to the recess.

2. A container according to claim 1, wherein each leg is provided at its free end with an inwardly extending arcuate configuration to form, together with the other legs, a substantially circular central recess when the legs are in a collapsed position, thereby to facilitate engagement with a finger for manually extending the same to an upright position.

3. A container according to claim 2, wherein the sides of each leg are tapered at least in part on an inner surface facing each recess and extending to the free ends thereof, and each recess is provided with a lateral member depending within each recess at a position intermediate each said depending stop member and the center of said container and engageable with said tapered surface to level said legs substantially flush with the bottom of the container when in the collapsed position and to elevate the inner ends of said legs when in the collapsed position, the elevation of said legs being facilitated by a further central recess within the bottom of the container beyond which the arcuate ends of said legs extend.

4. A container according to claim 1, wherein the outer side of each leg is provided with outwardly extending opposed wings disposed near to and outwardly from the opposed pins to engage the outer end walls of said recesses when the legs are in an upright position and to facilitate pivotal movement of the legs and to space the outer end walls of the legs from the outer end walls of the recesses.

5. A container according to claim 1, wherein the radial recesses in the bottom of the container terminate in a central recess extending within the bottom thereof to provide a space above the inner faces of said legs when in the collapsed position, the inner ends of said legs extending into said central recess sufficiently to facilitate manual engagement thereof for elevating the legs to an extended position.

6. A collapsible leg structure for a beverage container or the like comprising at least three housing means radially disposed on the base of said container and provided with a top, an outer end wall and side walls, said side walls being provided with holes adapted to receive in pivotal engagement pins extending outwardly on leg members, leg members provided with outwardly extended pins disposed tangentially with respect to the container to pivotally engage said holes, each leg member being provided with an outwardly projecting stop spaced from an outer end thereof to engage said outer end wall and facilitate rotation of said legs on said pins by providing rotational clearance between the outer end of the legs and the outer end walls of said housing means, and a stop member depending from the top of said housing member disposed to frictionally engage the top end of each leg when in an extended position and lock the same in such position.

* * * * *